US005743421A

United States Patent [19]

Gonzalez et al.

[11] Patent Number: 5,743,421

[45] Date of Patent: Apr. 28, 1998

[54] INSTANT CRATE

[76] Inventors: Carlos Gonzalez, 3924 Tedrich Blvd., Fairfax, Va. 22031; Claudio Garcia, Lamartine #121 Col. San Jeronimo, Monterrey, Nuevo Leon CP 64630, Mexico

[21] Appl. No.: 561,779

[22] Filed: Nov. 22, 1995

[51] Int. Cl.[6] ..... B65D 6/16; B65D 25/24; B65D 90/12

[52] U.S. Cl. ..... 220/4.28; 220/1.5; 220/617; 220/621; 220/633; 220/682; 217/13; 217/45

[58] Field of Search ..... 220/4.28, 1.5, 220/4.31, 4.32, 617, 618, 621, 633, 4.01, 615, 682; 217/12 R, 43 R, 13, 45

[56] References Cited

U.S. PATENT DOCUMENTS 3,410,441 11/1968 Rhyne ..... 220/4.28
3,847,299 11/1974 Page ..... 220/4.28
4,867,327 9/1989 Roland ..... 220/4.28 X

FOREIGN PATENT DOCUMENTS 1180303 10/1964 Germany ..... 220/4.28
0180067 7/1962 Sweden ..... 220/4.28
0987194 3/1965 United Kingdom ..... 220/4.28

*Primary Examiner*—Allan N. Shoap
*Assistant Examiner*—Niki M. Kopsidas

[57] ABSTRACT

Instant crate is generally related to shipping and storage crate containers. More specifically, it is concerned with a new improved knock-down and easy to assemble type of container. The container is comprised of six interlocking panels. The side and end walls engage with the base on assembly to form an open topped container. The top slides and interlocks with the side and end walls in a mating engagement to close the container.

3 Claims, 7 Drawing Sheets

INSTANT CRATE

BACKGROUND OF THE INVENTION

This invention relates to shipping and storage containers, and more specifically to a new and improved knock-down and easy to assemble -no tools needed- type container.

The volume if packages (with limits of 70 pounds maximum weight and 130 inches maximum length and girth combined) handled by package carriers, like the United States Postal Service (USPS) and the United Parcel Service (UPS), has seen a tremendous increase in the last two decades. A large majority of the packages are boxed in containers made of corrugated cardboard. These boxes are relatively inexpensive, but are very easily damaged and have limited reusable capabilities.

With cardboard boxes, if one of the sides is damaged, the whole box has to be discarded. With the invention presented here, if a panel (side) is damaged, it can be replaced and the box reused again. This factor alone presents a big economic advantage for the use of a "hard-wall-knock-down" crate over the commonly used cardboard container.

When the items to be packaged are heavy in weight or have a high density, the container must have a high bursting factor to support the stress (pounds per square inch) generated by this heavy weight. To obtain the proper high bursting factor, the container is reinforced either by double boxing, or by using boxes of double or triple wall thickness. The present invention offers an alternative which is more economical than the cardboard box, and offers the extra advantage of being highly reusable.

Fragile items are a major cause of concern for packaging systems. When using cardboard containers packaging transporters (USPS,UPS, etc.) require a minimum of 3 inches of insulation buffer between the items and the wall of the packaging box. This is done because the cardboard is not completely rigid and may be stretched or punctured easily under pressure. The invention presented here has hard walls (wood, plastic, etc.) which will considerably reduce the need for this buffer, thus making the packaging more economical.

The public not only does not generally have easy access to crates, but high cost and the time consuming nature of a carpenter built crate further diminishes their accessibility. There is a need for an easy to assemble "instant" crate. To assemble the present invention, no tools are required, not even fastening means such as nails, adhesives, etc., or the efforts of skilled personnel.

Freight motor carriers very frequently use crates to transport materials. These crates are usually assembled by fastening the panels with nails, screws, strapping (poly or steel), etc. The assembling process thus requires the additional materials/tools needed for fastening. To reuse a crate in this fashion, the carriers have to either reuse it immediately, or disassemble it because it occupies a lot of space, and space in a warehouse is always limited. The disassembling process is not easy either, and sometimes the crates are easily destroyed. Not only will the invention presented here facilitate the assembling and disassembling process of the crate, it will also reduce storage space since each crate is disassembled into 6 separate panels. This separate panel capability thus allows for several crates to be stacked, the space occupied being no bigger than the largest panel in the crate.

Freight motor transportation companies use fork-lifts to move loads in their warehouse, as well as to load/unload the shipping truck carriers. In the present invention, the side walls are extended as to define a space at the bottom of the container, this area may be used for entry of the lifting tines of a fork-lift or the like.

SUMMARY OF THE INVENTION

BRIEF DESCRIPTION OF THE DRAWINGS

Other objects and advantages of the invention will become more apparent from the specifications taken in conjunction with the accompanying drawings, in which.

DETAILED DESCRIPTION OF THE INVENTION

An instant crate is comprised of 6 interlocking panels. A top panel (numbered 1) depicted in FIGS. 1, 1A, 4, 5, 6 and 6A, two end panels (numbered 12) depicted in FIG. 4, two side panels (numbered 17) depicted in FIGS. 2, 2A, 2B, 4, and 5, and a base panel (numbered 26) depicted in FIGS. 3, 3A, 3B, 3C, 4 and 5.

Figure 1:
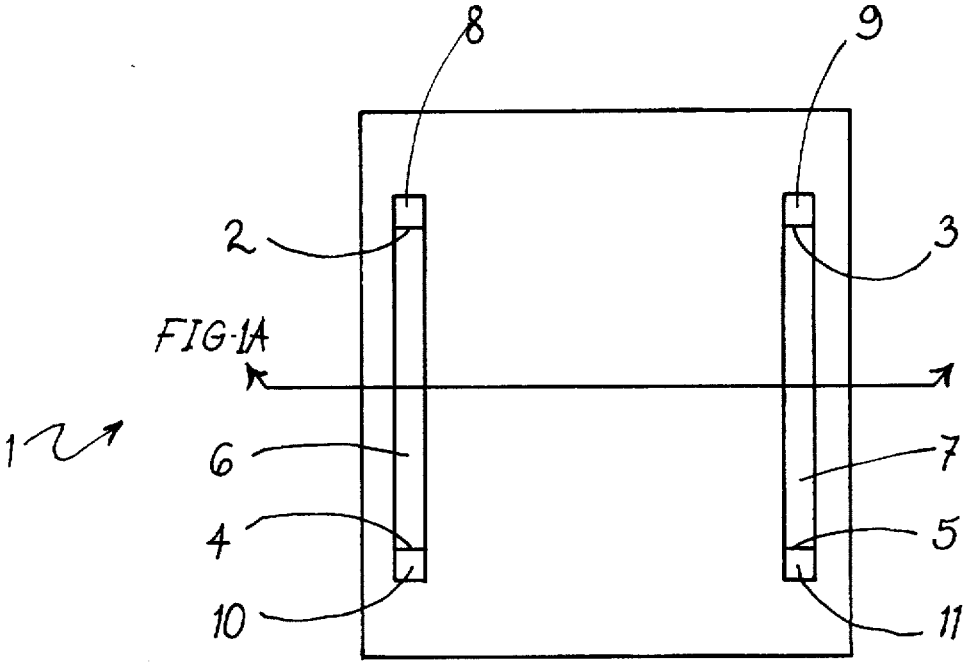
FIG. 1 is a top view of a top panel.
Figure 1A:
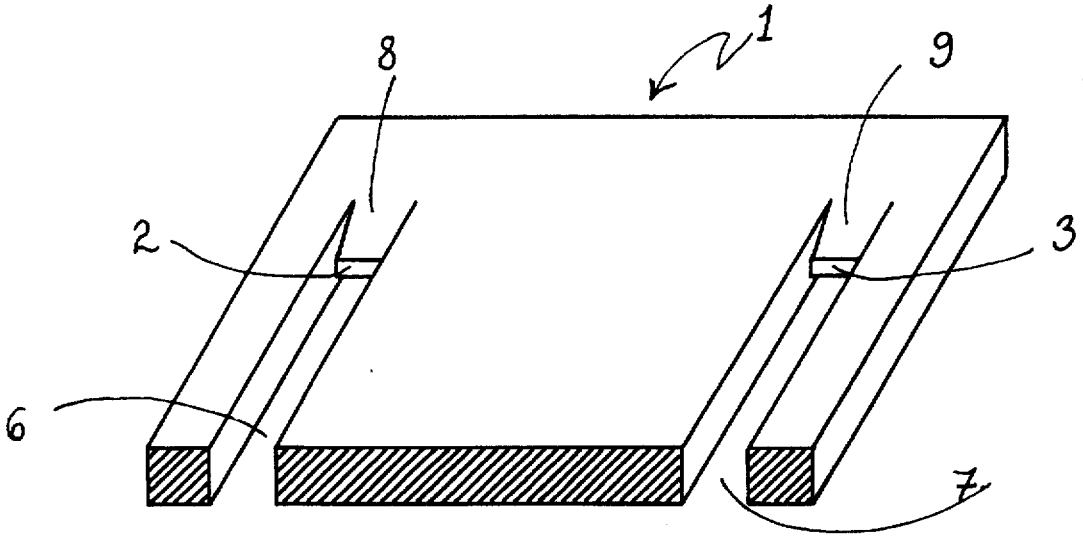
FIG. 1A is a perspective view of a section of a top panel.
Figure 2:
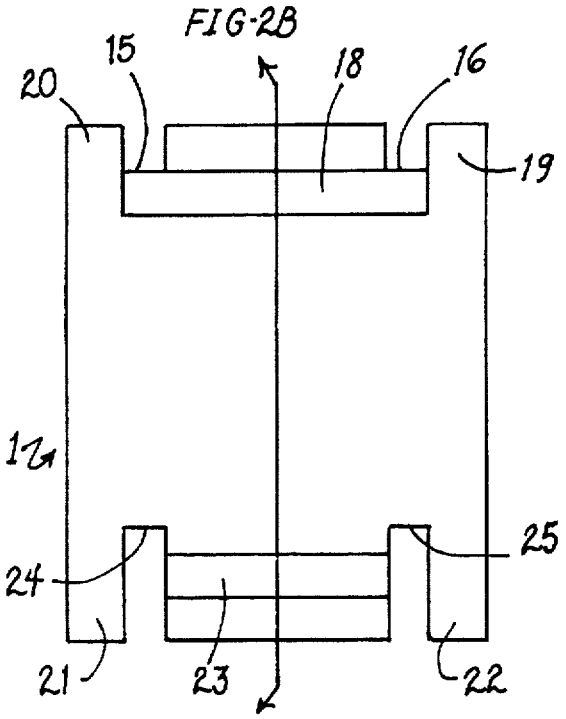
FIG. 2 is a view from the inside of the instant crate of a side panel.
Figure 2A:
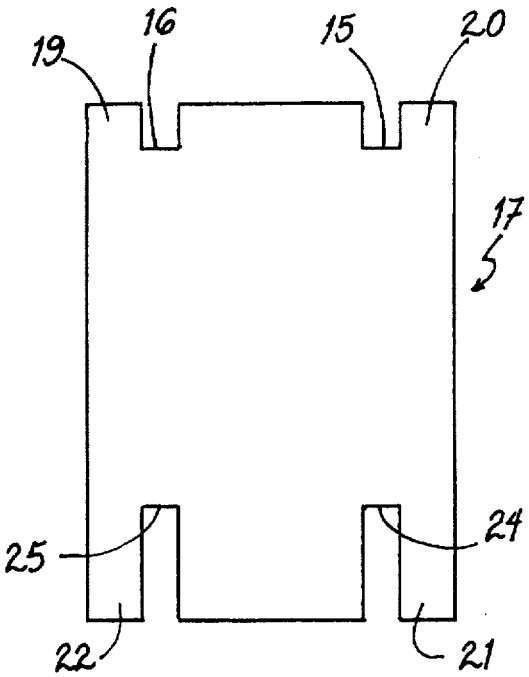
FIG. 2A is a view from the outside of the instant crate of a side panel.
Figure 2B:
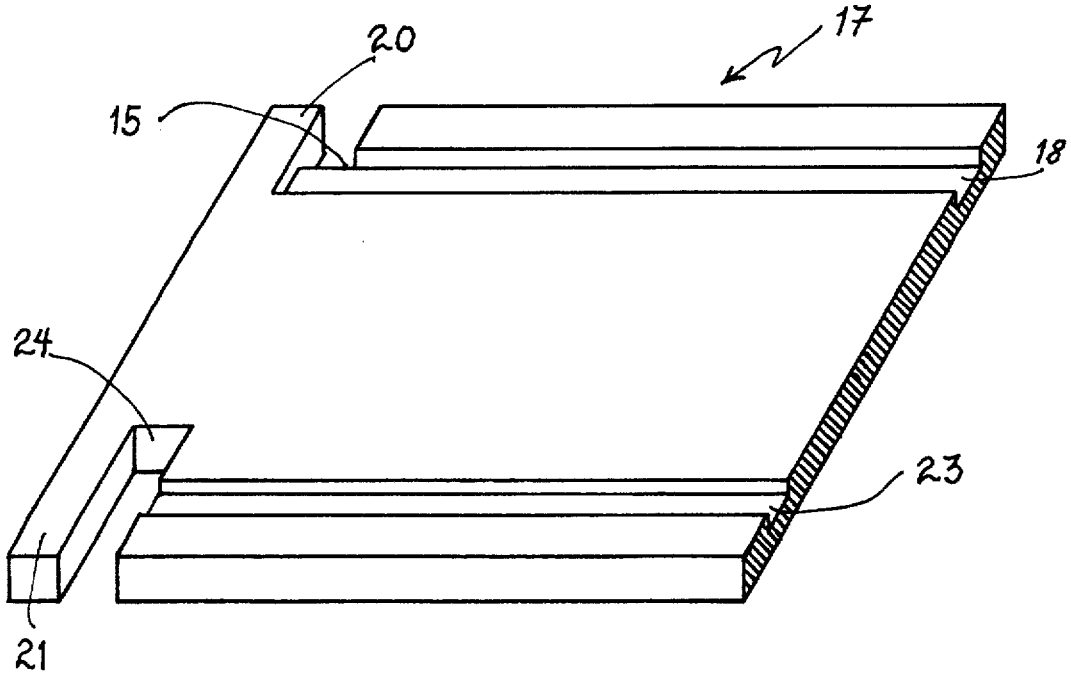
FIG. 2B is a perspective view of section a of a side panel.
Figure 3:
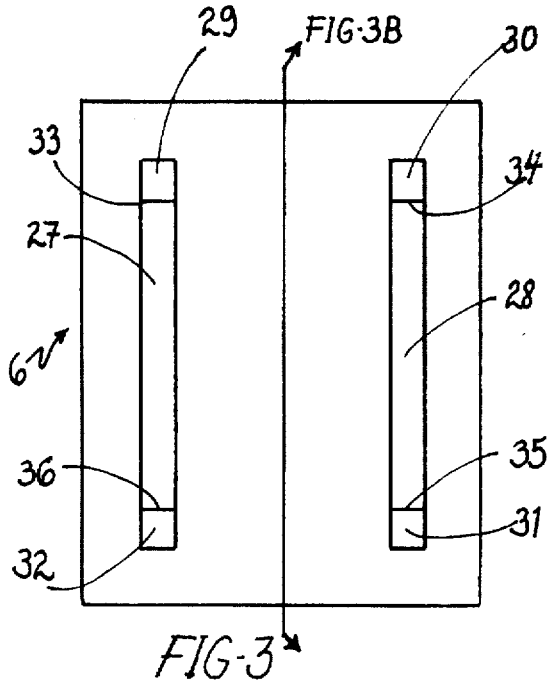
FIG. 3 is a view from the outside of an instant crate of a base panel.
Figure 3A:
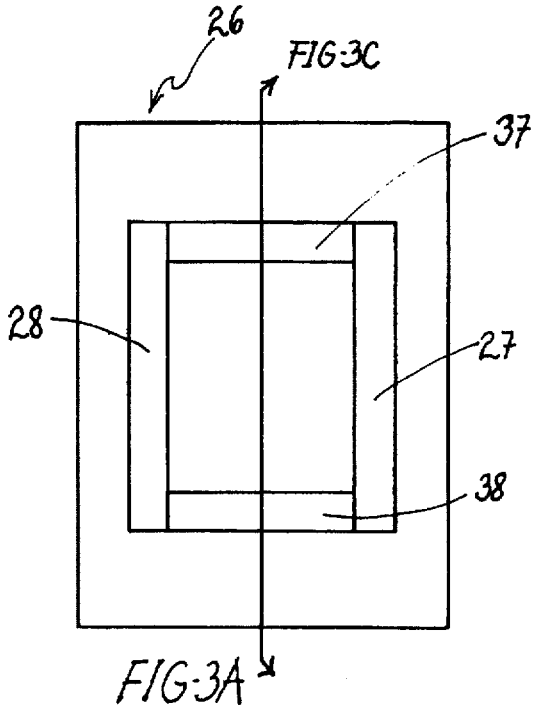
FIG. 3A is a view from the inside of an instant crate of a base panel.
Figure 3C:
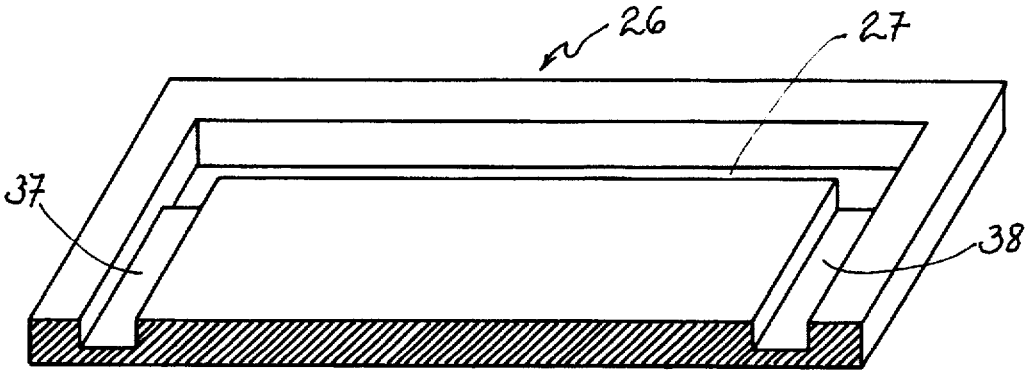
FIG. 3C is a perspective view of section a of a base panel.
Figure 3B:
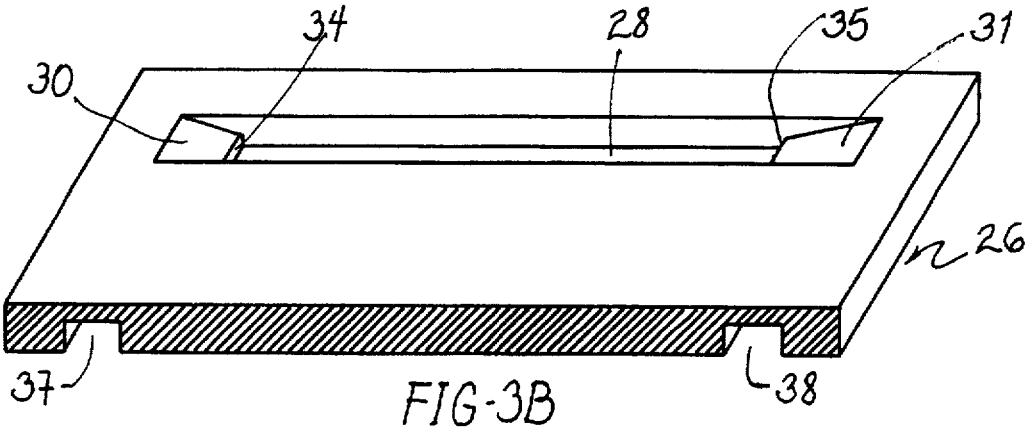
FIG. 3B is a perspective view of section a of a base panel.
Figure 4:
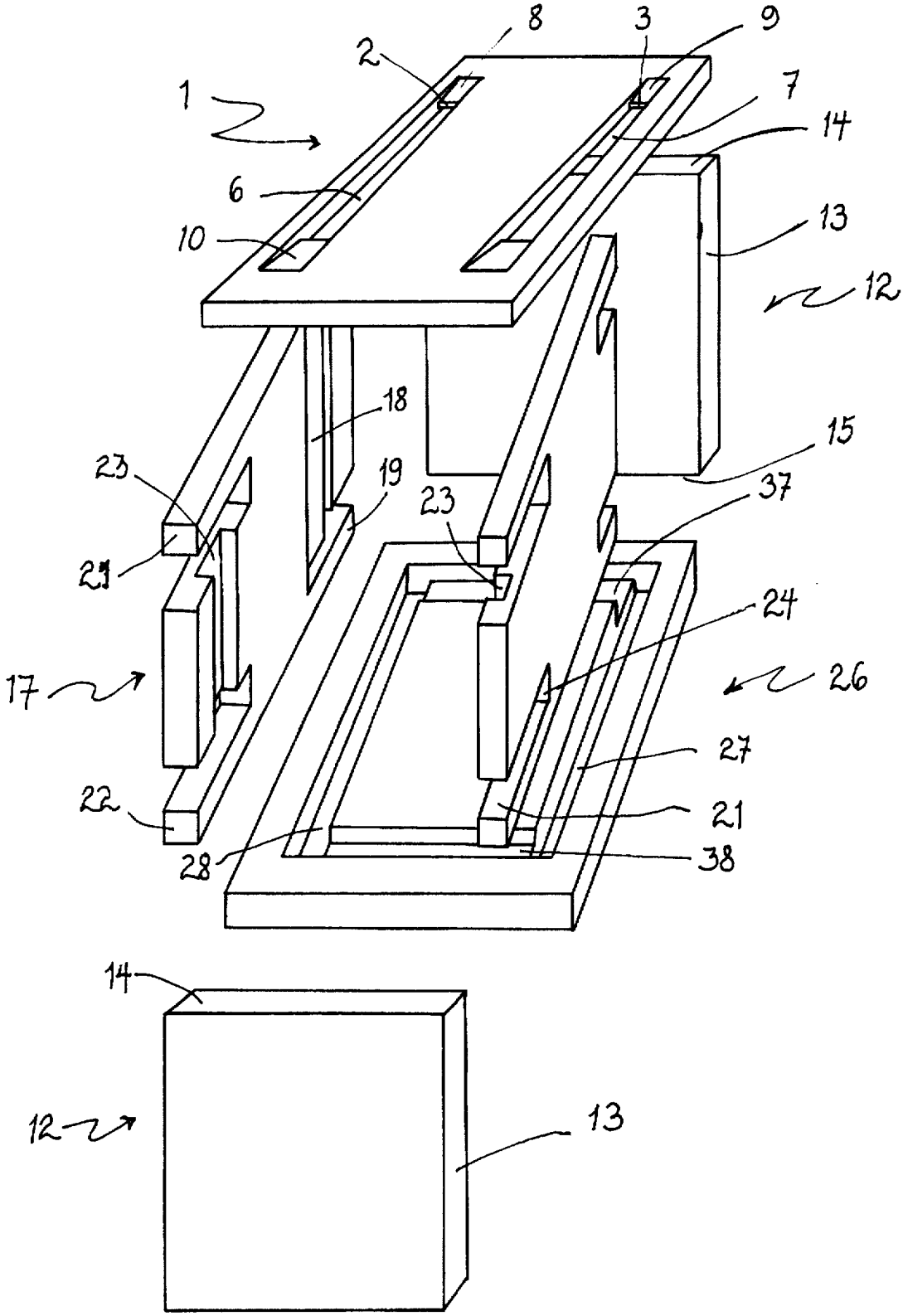
FIG. 4 is an exploded perspective view of an instant crate. It shows the six interlocking panels that comprise the crate.
Figure 5:
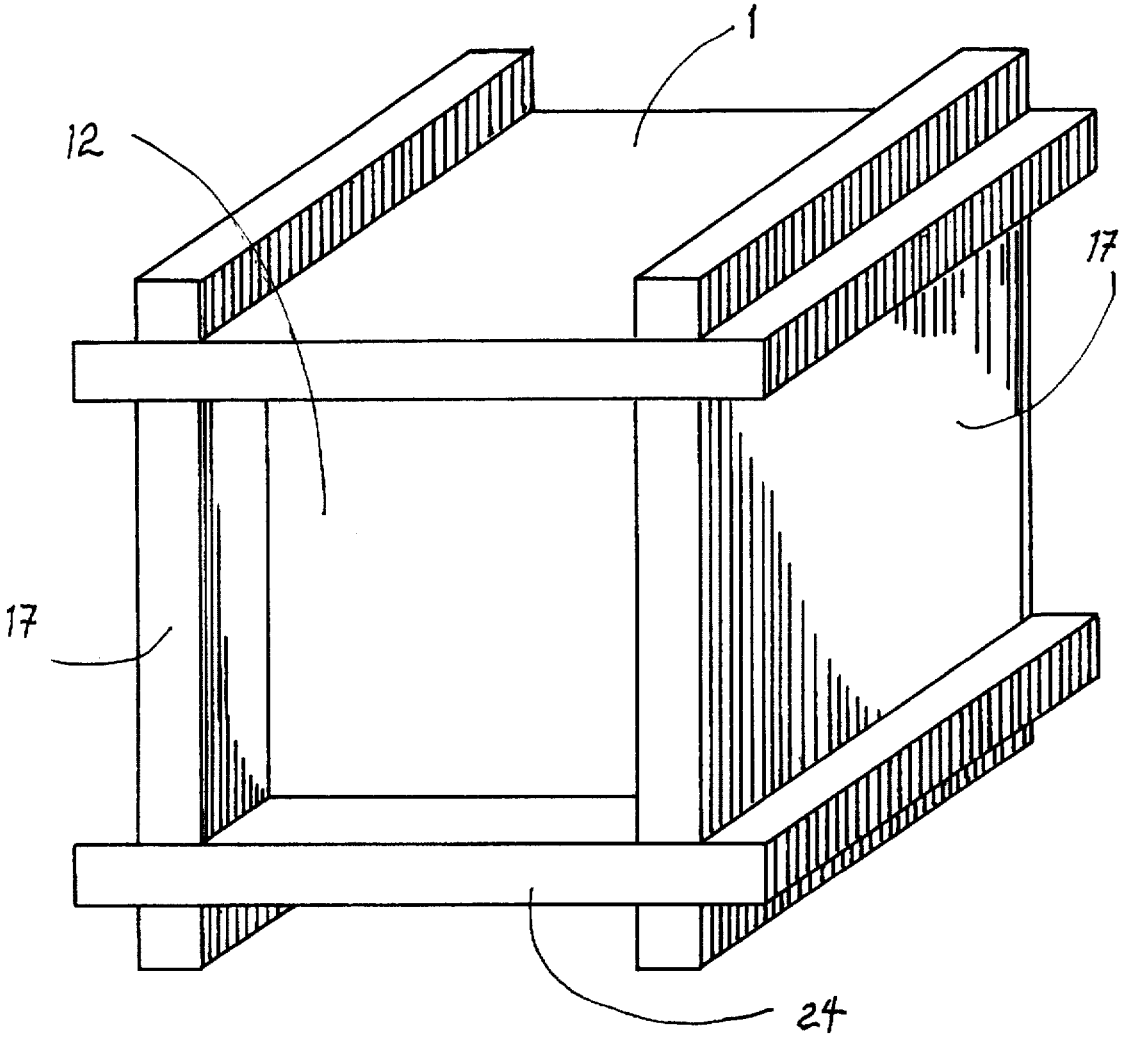
FIG. 5 is a perspective view of an instant crate fully assembled.

To assemble an instant crate like the one depicted in FIG. 5, you start with a base panel 26 turned so you can see the said base panel as in FIG. 3A. Now take a side panel 17 of FIG. 2 and turn it until groove 23 of said side panel is facing said base 26. Then proceed to insert extension 22 of said side panel into opening 28 of said base until side 25 of said side panel is mating with side 35 of said base. Push extension 19 of said side panel through opening 28 of said base until such extension is out of the opening. Slide the said side panel until side 16 of said side panel mates with side 34 of said base panel. After the mating of said side panel and said base panel, two rib extensions have formed: one rib extension runs along and parallel to said base panel where said base panel interlocks with said side panel, and another rib extension runs along and parallel from said side panel creating a support above ground level for said base panel. At this point, groove 18 of said side panel is also perpendicular to groove 37 of said base, making a continuous "L" shaped track, and groove 23 of said side panel is perpendicular to groove 38 of said base, also making a continuous "L" shaped track. Now take the other side panel 17 of FIG. 2 and turn it until groove 23 of said side panel is facing said base 26. Then proceed to insert extension 21 of said side panel into opening 27 of said base until side 24 of said side panel is mating with side 36 of said base. Push extension 20 of said side panel through opening 27 of said base until such extension is out of the opening. Slide the said side panel until side 15 of said side panel mates with side 33 of said base panel. After the mating of said side panel and said base panel, two rib extensions have formed: one rib extension runs along and parallel to said base panel where said base panel interlocks with said side panel, and another rib extension runs along and parallel from said side panel creating a support above ground level for said base panel. At this point groove 18 of both said side panels and groove 37 of said base, form a continuous "U" shaped track on one side of the crate. Grooves 23 of said side panels and groove 38 of said base also form a continuous "U" shaped track on the other side. Now take one end panel 12 of FIG. 4 and slide sides 13 of said end panel through the track made by the groove 18 of said side panels and groove 37 of said base. Take another end panel 12 of FIG. 4 and slide sides 13 of said end panel through the track made by grooves 23 of said right side panel and said left side panel and groove 38 of said base. At this point we have a top open container formed by the base panel, the side walls, and the end walls. To store items you place them inside the top open container. All stored items should be below a parallel plane that extends from the top of the exposed sides of the end panels 12.

Figure 6:
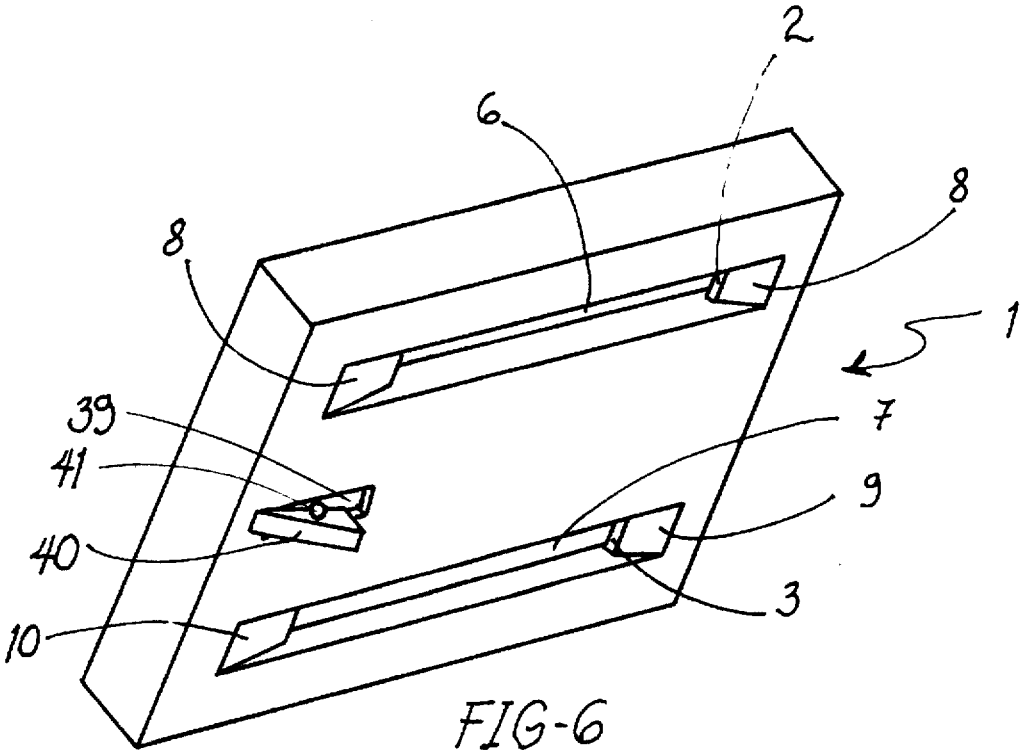
FIG. 6 is a perspective of the bottom of a top panel showing how the lock mechanism is attached to the panel.
Figure 6A:
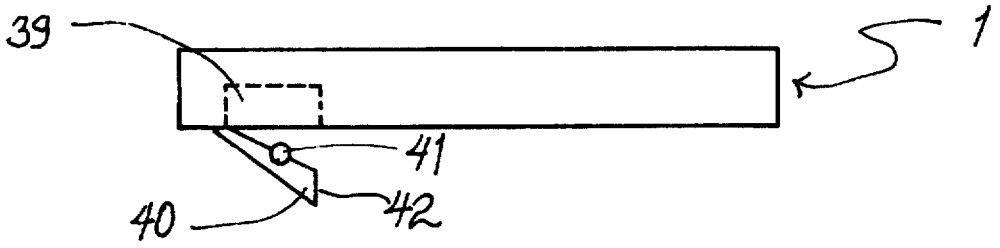
FIG. 6A is a side view of the top panel with a locking mechanism.
Figure 7:
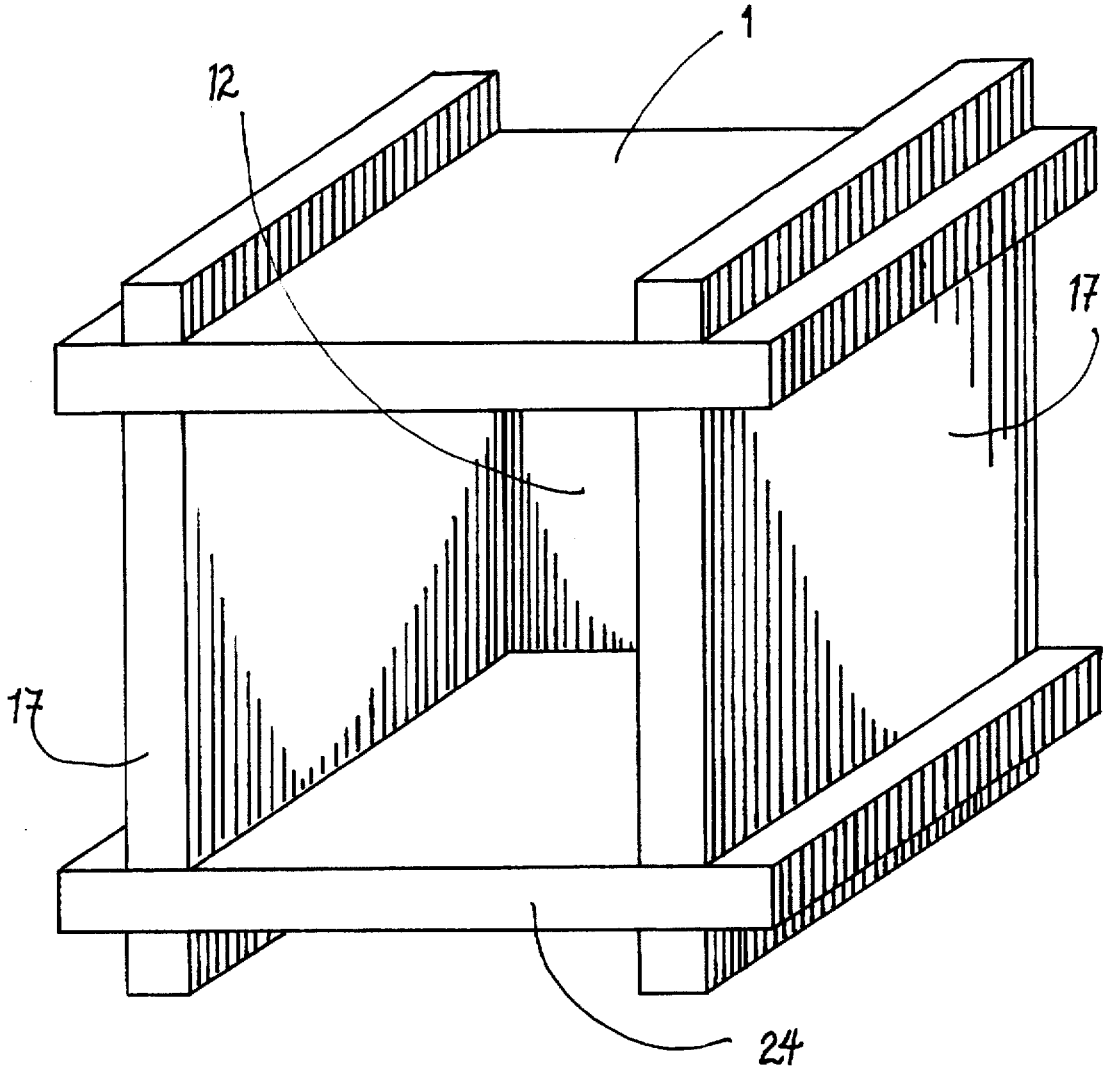
FIG. 7 is a perspective view of an instant crate with an open end wall.

To close the instant crate, you take the top open container described above and a top panel 1 in FIG. 1, then proceed to insert extension 22 of one of the said side panel into opening 7 of said top panel at the same time that you insert extension 21 of the other said side panel into opening 6 of said top panel. Push and slide slanted surfaces 10 and 11 of said top panel until sides 24 and 25 of said side panels are mating with sides 4 and 5 respectively of said top panel. Push extensions 19 and 20 of said side panels through openings 6 and 7 respectively of said top panel until such extensions are out in the open. Slide slanted surfaces 8 and 9 of said top panel until sides 2 and 3 mate with sides 15 and 16 of side panels respectively. At this point we have a closed crate. FIGS. 6 and 6A show a top panel with a locking mechanism 40. When the top panel slides on the side panels to close the crate (as described above) locking latch 40 will be pushed up by the pressing of such latch against the end panel corresponding to the location of said latch. Groove 39 will hide said latch and permit the complete sliding of said top until said latch clears the said end panel and returns to its original position. (A position in which side 42 of said latch is touching said end panel locking said top panel from sliding back and opening the crate). To open the crate, latch 40 of the top panel must be pushed up until it hides in groove 39, then said top panel can slide back and be open as explained above. Groove 41 of latch 40 can be used to insert a lock instrument. For example, a lock with a key or a wire with a wax seal used to prevent the pushing up of the latch, and thus the opening of the crate. Take a closed crate as in FIG. 1 and open it following the above described procedure, proceed to remove one of the end walls 12 (either one will produce the same end result), then close this container by locking the top panel following the above described procedure, the resulting container will be a one side open container as shown in FIG. 7.

Having fully described an operative embodiment of this invention, we now claim:

1. A knock-down, reusable container, having two side walls, two end walls, a top panel and a base, wherein:

said side walls each having a pair of opposed parallel length defining edges, and having a pair of opposed parallel width defining edges, each said side wall including a slot extending inwardly from each width defining edge and being adjacent and substantially parallel to one of said length defining edges, each said side wall further having a groove extending from each slot away parallel to the width defining edges and in a direction distal from the length defining edge to which the respective slot is adjacent;

said base having a pair of opposed parallel base-length defining edges, and having a pair of opposed parallel base-width defining edges, said base including a first and a second elongated aperture extending parallel to said base-length defining edges and a first base groove adjacent one of said base-width defining edges and a second base groove adjacent the other of said base-width defining edges, each groove extending between adjacent end portions of said first and second elongated apertures and parallel to said base width defining edges;

whereby one of said side walls extends through said first elongated aperture and forms a first rib extension, the other of said side walls extends through the second elongated aperture and forms a second rib extension, said first and second rib extensions are of substantially rectangular form and extend along the length of said base directly adjacent to said elongated apertures, wherein said first and second rib extensions support said base in spaced relation to a supporting surface;

one of said end walls engages one side wall groove of each side wall and rests upon said base within said first base groove, the other of said end walls engages the other groove of each side wall and rests upon said base within said second base groove;

said base extends laterally beyond each of said end walls to form horizontally extending third and fourth rib extensions, said third and fourth rib extensions being substantially rectangular and extending orthogonal to respective said end walls, said base also extends laterally beyond each of said side walls to form horizontally extending fifth and sixth rib extensions, said fifth and sixth rib extensions being substantially rectangular and extending orthogonal to respective said side walls.

2. The knock-down, reusable container of claim 1, further comprising a top panel, said top panel having a pair of opposed parallel top-length defining edges, and having a pair of opposed parallel top-width defining edges, said top panel including a third and a fourth elongated aperture extending parallel to said top-length defining edges and a third top groove adjacent one of said top-width defining edges and a fourth top groove adjacent the other of said top-width defining edges, each of said top grooves extending between adjacent end portions of said third and fourth elongated apertures and parallel to said top-width defining edges;

whereby one of said side walls extends through said third elongated aperture, the other of said side walls extends through the fourth elongated aperture, one of said end walls engages said third top groove, and the other of said end walls engages the fourth top groove.

3. The knock-down, reusable container of claim 2, further comprising a lock to prevent said top panel from being removed from the remainder of the container without unlocking said lock.

* * * * *